US005575468A

United States Patent [19]

Bell

[11] Patent Number: 5,575,468

[45] Date of Patent: Nov. 19, 1996

[54] POWER TURNING AND ORIENTING METHOD AND APPARATUS

[76] Inventor: David L. Bell, P.O. Box 307, Oquawka, Ill. 61469-0307

[21] Appl. No.: 328,459

[22] Filed: Oct. 25, 1994

[51] Int. Cl.[6] ..... B65H 5/00

[52] U.S. Cl. ..... 271/225; 271/185; 198/411; 198/412

[58] Field of Search ..... 271/184, 185, 271/225; 198/411, 412

[56] References Cited

U.S. PATENT DOCUMENTS

| | | | |
|---|---|---|---|
| 3,080,956 | 3/1963 | Salzmann | 271/184 X |
| 3,779,546 | 12/1973 | Wojtowicz et al. | 271/184 X |
| 4,928,807 | 5/1990 | Auerbach | 271/185 X |
| 5,114,137 | 5/1992 | Olson . | |
| 5,131,643 | 7/1992 | Graveson et al. | 271/184 X |
| 5,320,340 | 6/1994 | Bay . | |
| 5,393,366 | 2/1995 | Bell | 271/225 X |

FOREIGN PATENT DOCUMENTS

| | | | |
|---|---|---|---|
| 4300854 | 7/1994 | Germany | 271/225 |
| 301659 | 11/1993 | Japan | 271/225 |
| 2139196 | 11/1984 | United Kingdom | 271/184 |

*Primary Examiner*—David H. Bollinger
*Assistant Examiner*—Boris Milef
*Attorney, Agent, or Firm*—Woodard, Emhardt, Naughton Moriarty & McNett

[57] ABSTRACT

A turning and orienting device can receive an article such as a folded paper, envelope or the like, and can turn the article and/or rotate the article for re-orienting the article. An annular plate is constantly rotating, and a central plate in the same plane is fixed. Spring urged balls can receive the article therebeneath to urge the article against the plates; therefore, the portion on the stationary plate will be held still while the portion on the rotating plate will be moved in a circular path. By adjusting the location of the balls, and varying the point at which the .article is stopped, virtually any combination of turning and rotation of the article can be accomplished.

8 Claims, 3 Drawing Sheets

POWER TURNING AND ORIENTING METHOD AND APPARATUS

BACKGROUND OF THE INVENTION

1. Field of the Invention

This invention relates generally to the turning and orienting of folded papers, envelopes and similar articles, and is more particularly concerned with power means for selectively turning and orienting such articles.

2. Discussion of the Prior Art

In the handling of articles such as envelopes, folded papers and the like, it is frequently necessary to re-direct the articles. Sometimes the re-direction is simply to cause the articles to follow the course of the processing apparatus; other times re-direction is necessary to assist in re-orienting the articles for the next processing step. By way of example, a folded paper may need to be rotated to present the loose edge to a tabbing means, or any article may need to be re-oriented for application of a routing code, or postage, etc.

The prior art turning apparatus comprises primarily belt conveyors and the like, sometimes in conjunction with hold-down rollers to urge articles against the conveyor belt. It is also known to utilize stops adjacent to belt conveyors for selectively orienting articles. One such apparatus is shown in U.S. Pat. No. 5,114,137.

The prior art thus provides no versatile turning and orienting apparatus. Each device is designed for a particular turn and cannot be easily re-adjusted to cause a different turn. Turning and orienting devices therefore are usually custom designed to provide very specific turns of articles, with specific final orientation.

SUMMARY OF THE INVENTION

The present invention provides a versatile turning and orienting device comprising an annular driving means with cooperating hold-down means, and a holding means disposed centrally of said annular driving means and including cooperating hold-down means. An adjustable stop is in the path of an incoming article and determines the initial position of the article with respect to the driving means and the holding means. A second stop terminates motion of the article by the driving means, and an exit conveyor discharges the articles.

In one successful embodiment of the invention, the hold-down means comprises at least one spring-urged sphere for urging the article against the annular driving means; and, the holding means is a fixed disk having a similar hold-down arrangement. The hold-down can be rotated with respect to the path of the article and the second stop to vary the driving characteristics, hence the final orientation.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
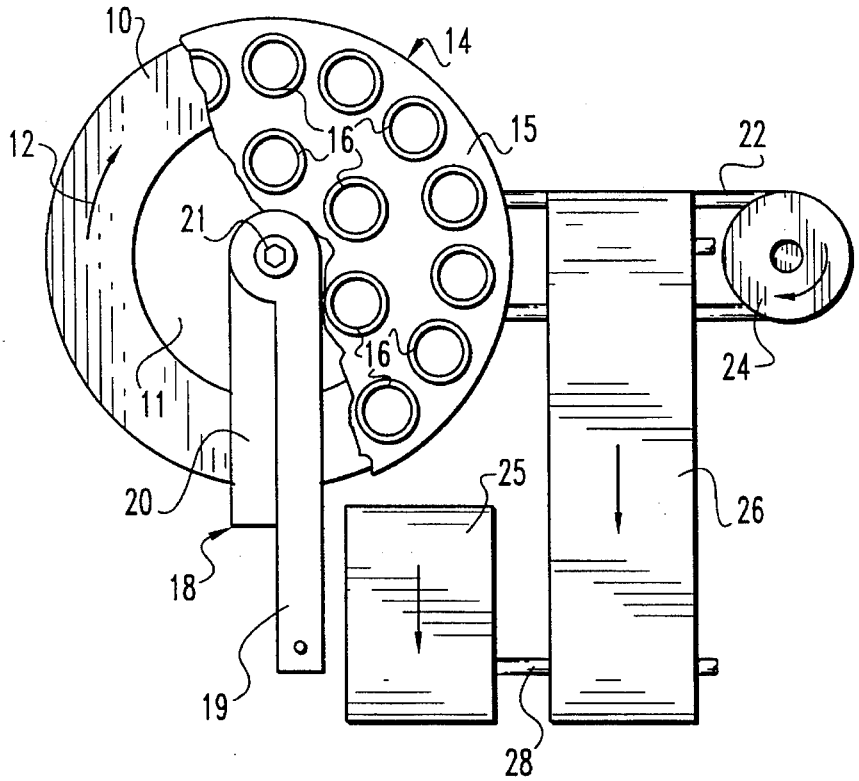
FIG. 1 is a top plan view showing a turning and orienting apparatus made in accordance with the present invention, portions thereof being broken away to show the construction.

Referring now in more detail to the drawings, and to that embodiment of the invention here presented by way of illustration, the apparatus shown in FIG. 1 includes an annular driving means 10, with a central holding means 11 concentric therewith. As will be discussed further below, the driving means 10 will be driven to rotate in the direction indicated by the arrow 12, and the holding means 11 is stationary. The upper surfaces of the driving means and the holding means are in substantially the same horizontal plane for receiving an article.

Disposed above the driving means 10 and the holding means 11 is a hold-down generally designated at 14. The hold-down 14 comprises a disk 15 supporting a plurality of holding points 16. A first group of holding points 16 cooperates with the driving means 10, and a second group cooperates with the holding means 11. The precise construction of the holding points 16 will be discussed hereinafter.

The hold-down 14 is partially broken away in FIG. 1 to show the stop means 18. The stop means 18 includes a fixed stop 19 and a movable stop 20. One end of the stops 19 and 20 is concentric with the driving means 10 and the holding means 11, and the movable stop 20 is rotatable about the center 21. It will be noticed that there is a screw 21 at the center; and, the screw 21 can be loosened to allow movement of the stop 20, and tightened to hold the stop in the set position.

To cause rotation of the driving means 10, there is a belt 22. The belt 22 is trained around a drive pulley 24 as the drive means. Those skilled in the art will understand that the pulley 24 can be driven by any known technique; but, in the preferred embodiment of the invention, a variable speed D.C. drive is used. Such drives are well known to those skilled in the art.

After an article has been appropriately turned and oriented, the article is discharged and conveyed away from the turning and orienting device. As here shown, there are two belts 25 and 26 to receive the article and assist in discharging the article. There is a common axis 28 which assures that the conveyor belts 25 and 26 are driven at the same speed. Again, the belts 25 and 26 are preferably driven by a variable speed drive, and one separate from the drive for the driving means 10.

Figure 2:
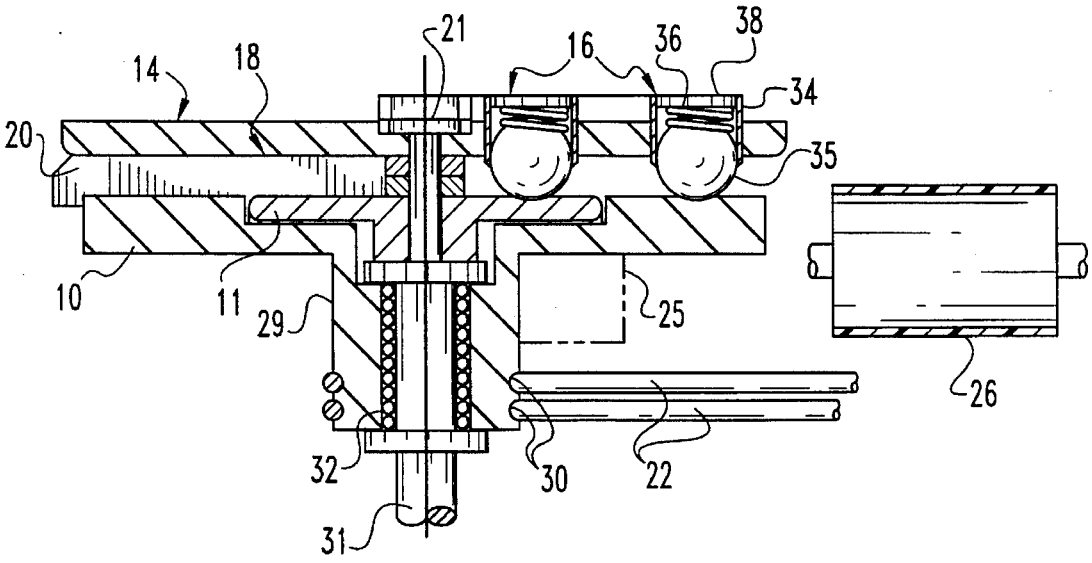
FIG. 2 is a diametrical cross-sectional view of the apparatus shown in FIG. 1, the adjustable stop being rotated 90°.
Figure 3:
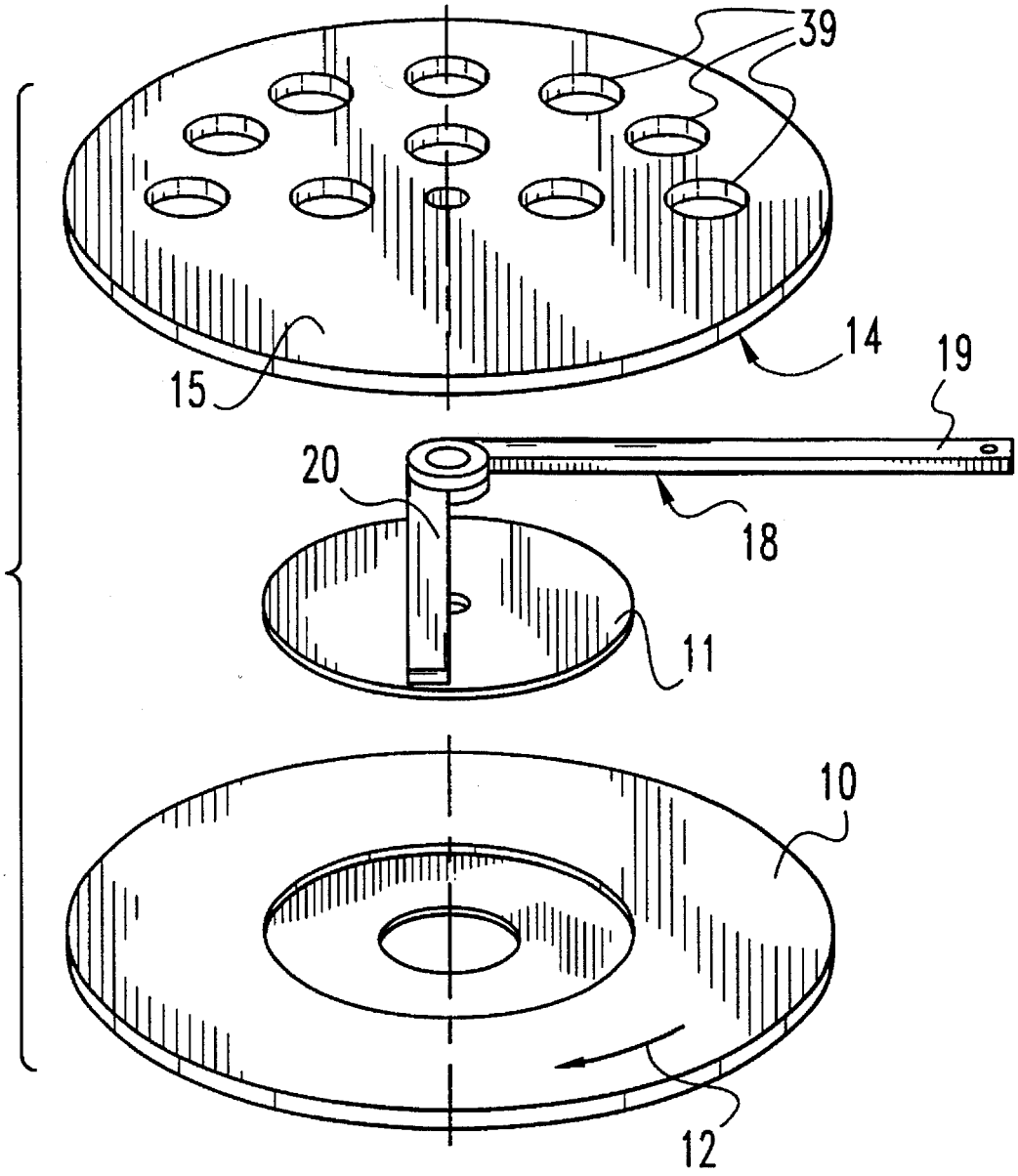
FIG. 3 is an exploded perspective view showing the principal operational pieces of the apparatus of FIG. 1; and, FIGS. 4–6 are schematic views showing some of the variable operational positions of the apparatus, and the resulting functions.

Attention is next directed to FIGS. 2 and 3 of the drawings which illustrate the construction of the apparatus in more detail. It will be seen that the driving means 10 is formed of a disk having a central hub 29 extending down therefrom. The hub 29 defines grooves 30 to receive the belts 22 for driving the driving means 10. While the belts 22 are here shown as round in cross-section, with semi-circular grooves 30, those skilled in the art will understand that a standard V-belt may be used, or a timing belt or other power transmission means.

The hub 29 rotates about a shaft 31, and bearing means 32 mounts the hub 29 on the shaft 31. Looking at the construction shown in FIG. 2, it will be understood that the shaft 31 is stationary, and the hub 29 rotates therearound. The holding means 11 is also mounted on the shaft 31, but is fixed thereto rather than being rotatable. Above the holding means 11, and spaced therefrom, is the hold-down 14. The stop means 18 is disposed between the hold-down 14 and the driving and holding means 10 and 11.

Since the shaft 31 is fixed, it will be readily understood that the hold-down 14, the holding means 11, and the stop means 18 are fixed. The driving means 10 is mounted by the bearings 32, and is the only piece that is readily rotatable about the shaft 31.

Looking at FIGS. 2 and 3, the construction of the holding points 16 is shown in detail. Each holding point 16 includes a generally cylindrical housing 34 having a ball 35 therein. A spring 36 urges the ball 35 downwardly, a threaded follower 38 holding the opposite end of the spring 36. Each of the holding points 16 is received within a hole 39 in the hold-down 14. The housings 34 may be threaded into the hold-down for adjustable positioning, or may be press-fit, welded or otherwise fixed in position. As here shown, the follower is threaded into the housing 34 so the follower 38 can vary the pressure on the spring 36; but, it will be understood that the housing itself may be threaded into the hold-down 14 as a means for varying the pressure of the holding points 16, or to allow thicker or thinner articles to be received under the holding points 16.

Figure 4:
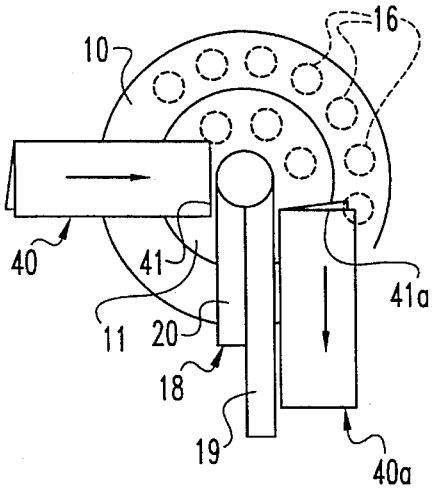
Figure 5:
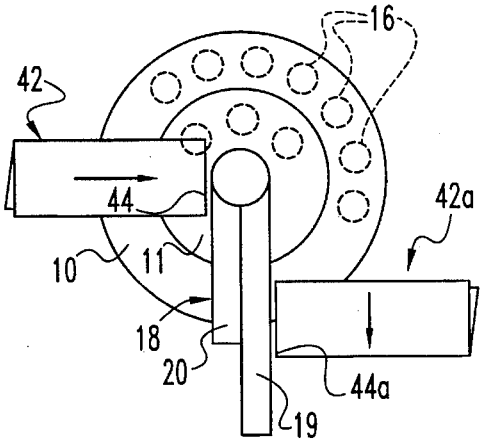
Figure 6:
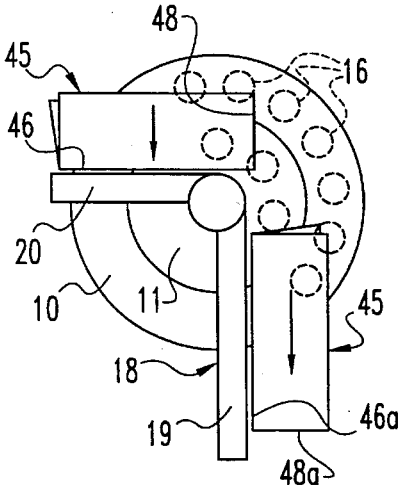

With the above and foregoing in description in mind, the operation of the device should be understandable. For a discussion of the operation, attention is directed primarily to FIGS. 4–6 of the drawings. FIGS. 4–6 are schematic, and the hold-down 14 has been omitted to show the operation; however, the hold-down points 16 are shown in phantom.

FIG. 4 illustrates the present apparatus arranged to receive an article, and redirect the article at 90°, while also rotating the article 270°. It will be noticed that the movable stop 20 is placed parallel to the fixed stop 19, and the article 40 enters from the left, at the "9:00 o'clock" position. The article 40 will be stopped in its linear movement by the stop 20; and, motion of the driving means 10 will cause an upward motion of the article. It will be noticed, however, that the leading edge 41 is quickly engaged on the holding means 11 so the article 40 will pivot. As the body of the article 40 reaches the hold-down points 16 over the driving means 10, the article will be rather positively driven. Since the body of the article is being moved in a circular path and the edge 41 is being held, the article will rotate, and such rotation will continue until the article 40 engages the fixed stop 19, the article being here designated at 40*a*. The edge 41 of article 40 is designated at 41a on the article 40*a*.

Looking next at FIG. 5 of the drawings, it will be seen that the movable stop 20 is in the same position as in FIG. 4, and the article 42 enters from the same direction as in FIG. 4. It should be noticed, however, that the hold-down points 16 are rotated, which is to say the hold-down 14 has been rotated in a counter-clockwise direction. With this arrangement, the operation begins the same, with the leading edge 44 retarded by the holding means 11, and the body of the article 42 carried in a circular path by the driving means 10. In the arrangement of FIG. 5, the article 42 is released by the hold-down points 16 sooner, so the final quarter-turn of the article is omitted. The edge 44*a* engages the fixed stop 19 after the article 42*a* has been rotated 180°.

FIG. 6 of the drawings shows another arrangement of the apparatus of the present invention to achieve another reorientation. The movable stop 20 is positioned at 90° with respect to the fixed stop 19, and the article 45 enters the apparatus from the "12:00 o'clock" position. The hold-down 14 has been rotated in a clockwise direction so the hold-down points 16 extend very close to the fixed stop 19. Thus, the article 45 enters the device, and the leading edge 46 is stopped by the movable stop 20. At this time, the right-hand end is engaged by the holding means 11, and by the driving means 10. This will cause rotation of the article 45, the rotation continuing as the driving means 10 carries the body of the article 45 in a circular path while the holding means 11 retards the end 48.

Once the article 45 has been rotated about 90°, the edge 46 will have moved into position to engage the fixed stop 19. As a result, rotation of the article 34 will cease, and the article will be oriented as indicated by the article 45*a*. As before, the edges 46 and 48 of article 45 are designated at 46*a* and 48*a* for article 45*a*.

With the above examples in mind, it will be understood by those skilled in the art that the present invention provides a highly versatile turning and orienting device. The position of the movable stop 20 can be varied to fix the incoming position of an article, while the hold-down 14 can be angularly adjusted to locate the hold-down points 16. The location of the hold-down points determines when an article will be engaged, and when it will be released. The combination of these factors determines the turning and the rotation of an article.

In all the above examples, it will also be realized that the article 40*a*, 42*a* and 45*a* will subsequently be carried by the discharge conveyors 25 and 26, and these conveyors can connect to other, further handling means.

It will be also understood by those skilled in the art that the particular embodiment of the invention here presented is by way of illustration only and is meant to be in no way restrictive; therefore, numerous changes and modifications may be made, and the full use of equivalents resorted to, without departing from the spirit or scope of the invention as outlined in the appended claims.

I claim:

1. Apparatus, for turning and orienting an incoming article moving along a linear path, said apparatus comprising annular driving means, means for rotating said annular driving means, holding means centrally of said annular driving means, a first plurality of holding points disposed above said driving means, and a second plurality of holding points disposed above said holding means, means for selectively rotating said first and second plurality of holding points with respect to said holding means, and stop means extending at least partially across said holding means and said driving means for receiving an article thereagainst for stopping said linear motion of said incoming article.

2. Apparatus as claimed in claim 1, wherein said stop means comprises a fixed stop extending radially of said holding means and said driving means, and a movable stop adjustable with respect to said fixed stop.

3. Apparatus as claimed in claim 2, wherein each holding point of said plurality of holding points includes a housing, a ball within said housing, and means for urging said ball downwardly with respect to said housing, so that said balls in said first plurality of holding points engage said driving means, and said balls in said second plurality of holding points engage said holding means.

4. Apparatus as claimed in claim 3, wherein said means for urging said ball downwardly comprises a spring, so that an article can be received between said balls in said first plurality of holding points and said driving means.

5. A method for turning and orienting an article comprising the steps of linearly feeding said article along a first path onto a rotating annular driving means and stopping the linear motion when one edge of the article is on a fixed disk centrally of said annular driving means, urging said one edge against said fixed disk, urging the body of the article against said annular driving means so that the body of the article is moved in a circular path while said edge of the article is held for causing rotation of the article, then urging an edge of the article against a stop for stopping the rotation of the article, and linearly discharging the article along a second path.

6. A method as claimed in claim 5, wherein said first path and said second path are angularly related to each other.

7. A method as claimed in claim 6, wherein said first path and said second path are at right angles to each other.

8. A method as claimed in claim 5 wherein said first path and said second path are parallel to each other.

* * * * *